United States Patent [19]

Sternberg

[11] 4,081,856

[45] * Mar. 28, 1978

[54] APPARATUS FOR FORWARDING AND CHARGING A BUNDLE OF FILAMENTS

[75] Inventor: Ernest M. Sternberg, Chapel Hill, N.C.

[73] Assignee: Monsanto Company, St. Louis, Mo.

[ * ] Notice: The portion of the term of this patent subsequent to Jun. 29, 1993, has been disclaimed.

[21] Appl. No.: 712,636

[22] Filed: Aug. 9, 1976

Related U.S. Application Data

[62] Division of Ser. No. 573,275, Apr. 29, 1975, Pat. No. 4,009,508.

[51] Int. Cl.[2] ..... H01T 19/04

[52] U.S. Cl. ..... 361/225

[58] Field of Search ..... 361/225, 229; 264/24

[56] References Cited

U.S. PATENT DOCUMENTS 3,967,118 6/1976 Sternberg ..... 361/229 X

*Primary Examiner*—Harry L. Moose, Jr.

*Attorney, Agent, or Firm*—Donald J. Fitzpatrick; Robert L. Broad, Jr.

[57] ABSTRACT

Apparatus for charging and forwarding a group of filaments to a web formation zone wherein an attenuator forwards the group of filaments along a path into impingement with a target electrode positioned downstream from the attenuator and in the filament path, a charging electrode being positioned to cooperate with the target electrode to form a filament-charging electric field at the location where the filament group impinges and is being spread by the target electrode. The filaments are advanced in such a manner that the filaments are in a bundle configuration prior to contact with the target electrode and are free to spread from the bundle configuration to a fan configuration as they pass through and are charged by the electric field. The apparatus is provided with a plurality of attenuators and associated charging electrodes positioned on opposite sides of the target electrode in a staggered relationship to spread filament bundles into fan configurations and forward the filaments to the web formation zone. The filament groups in fan configurations intermingle with adjuacent filament groups below the target electrode in such a manner that the groups of filaments entering the web formation zone form a curtain.

3 Claims, 5 Drawing Figures

APPARATUS FOR FORWARDING AND CHARGING A BUNDLE OF FILAMENTS

This application is a division of application Ser. No. 573,275, filed Apr. 29, 1975 in the name of Ernest M. Sternberg for "Method For Forwarding and Charging A Bundle Of Filaments," now U.S. Pat. No. 4,009,508.

BACKGROUND OF THE INVENTION a. Field of the Invention

The invention relates to apparatus for charging and forwarding filaments to a web formation zone.

b. Description of the Prior Art

It is known to make nonwoven fabrics from continuous synthetic filaments by passing groups of filaments through attenuators to drive the filaments onto a foraminous belt where a nonwoven web is formed as the belt is moved past the attenuators. The web is subsequently bonded in a conventional manner to increase the strength and enhance other properties of the web. If a salable product is to be made, uniformity of the web is of paramount concern. If the filaments laid down to form the web are not properly separated the web will have a ropy, unattractive appearance which will render it unsalable.

While the turbulence of the air moving through the attenuator will tend to separate the filaments from each other to some extent, it has been found that even better filament separation can be achieved by the use of triboelectricity or by using a corona discharge system which applies an electric field and thereby an electric charge to the filament group. Several problems are encountered in charging filament groups and in controlling the distribution of a number of filament groups which may go into a web having a width of as much as several meters.

One of the problems encountered in forming a web such as described above is that of filament separation. U.S. Pat. No. 3,163,753, for example, discloses a filament charging apparatus wherein a wide layer of filaments is charged as the layer is pulled under tension over a target electrode. Since the filaments are in a layer it is necessary to use a plurality of corona discharge electrodes positioned in a row perpendicular to the direction of travel of the filaments in order to equally charge all of the filaments.

Another problem encountered in web formation is the interaction of adjacent filament bundles and adjacent corona charging systems which are necessary to form a web several meters in width. In order to have uniformity across a web several meters in width it is necessary that the filament groups being advanced to the web, and the corona charging systems associated with each group, be positioned in close proximity to each other. This can in some cases lead to undesirable electric field distortion and physical interference between adjacent filament groups. In the present invention, the filament forwarding and charging systems can be positioned in close proximity to each other without adverse effect.

U.S. Pat. No. 3,338,992 is typical of the prior art patents wherein a corona charging system is used upstream of an attenuator to apply a charge to a group of filaments, the filaments being held under sufficient tension to prevent separation of the filaments in the group before the filaments pass through the attenuator. The problem with this arrangement is that it is more difficult to obtain a high filament charge when the filaments are held together. In addition, some of the charge can be lost as the group passes through the attenuator and there is a risk of having the charged filaments stick to the inside of the attenuator. In the present invention, the corona charging system is positioned downstream of the attenuator and filaments are fed in such a manner that the filament group spreads from a bundle configuration into a fan configuration as the charge is applied. This permits a significantly higher filament charge and much reduced risk of charge loss.

The British counterpart of U.S. Pat. Nos. 3,338,992, 932,482, suggests that a corona discharge can be used in either upstream of or downstream of the attenuator but offers no explanation of how this might be done downstream of the attenuator.

U.S. Pat. No. 3,689,608 is typical of several patents which disclose apparatus for making a web from plexifilaments wherein the plexifilament is deflected and spread to fall past a target electrode to a charged belt. The deflector spreads the plexifilament above the electrode, so that it is necessary to use an array of charging needles disposed laterally across the path of the spread plexifilament in order to obtain a uniform charge across the plexifilament.

SUMMARY OF THE INVENTION

This invention provides an apparatus for applying a very high electric charge to a plurality of filaments being advanced by an air nozzle to a web forming zone, the charging of the filaments being achieved by impinging the filaments in bundle form on a target electrode and applying a charge to the filaments at the location of impingement while allowing the filaments to spread from a bundle configuration to a fan configuration as the filaments are being charged. A preferred embodiment utilizes at least two corona discharge electrodes so positioned that the moving filaments first pass through the electric field created by one of the corona discharge electrodes and then immediately pass through the electric field created by the other corona discharge electrode. The electric fields are created between the corona discharge electrodes and a target electrode positioned to be engaged by the moving filaments downstream from the attenuator. To enhance uniformity across a wide web, the target electrode takes the form of an elongated bar, with a plurality of filament groups being fed into contact with opposite sides of the target electrode bar from attenuators positioned above the target electrode in a staggered relationship on opposite sides of the target electrode and in alignment with the attenuators to apply multiple electric fields to each group of filaments being advanced to the web formation zone.

DETAILED DESCRIPTION OF THE INVENTION

Figure 1:
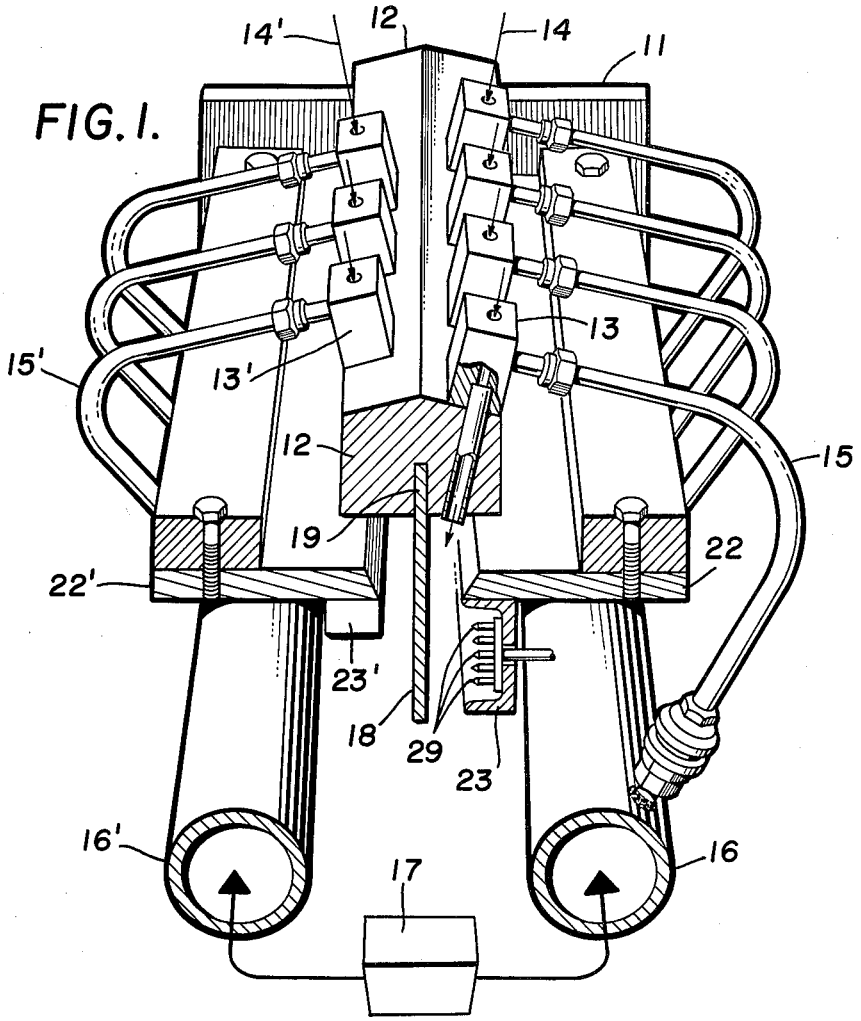
FIG. 1 is a perspective view of a preferred embodiment of the apparatus of the present invention, showing the general relationship of the various parts of the apparatus.

Referring now in detail to the drawings, which show one embodiment of the invention, there is shown an end plate 11 which is one of a pair of end plates positioned at some distance apart to support the apparatus described below. An elongated member 12 secured between the end plates 11 serves to support a plurality of filament attenuators or air nozzles 13 and 13' which may be of a conventional type. The purpose of the attenuators 13 and 13' is to receive groups of filaments 14 and 14' from spinnerettes (not shown) above the attenuators, draw these filaments in the space between the attenuators and the spinnerettes and forward the groups of filaments downward toward a web formation zone (not shown) for a conventional type. The filaments are forwarded through the attenuators by compressed air which is fed to the attenuators 13 and 13' through lines 15 and 15' connected to supply manifolds 16 and 16', respectively. The attenuators may take the form of any gas driven nozzles capable of forwarding the filaments, with or without drawing the filaments. The manifolds 16 and 16' are connected to a source of compressed air 17.

Figure 2:
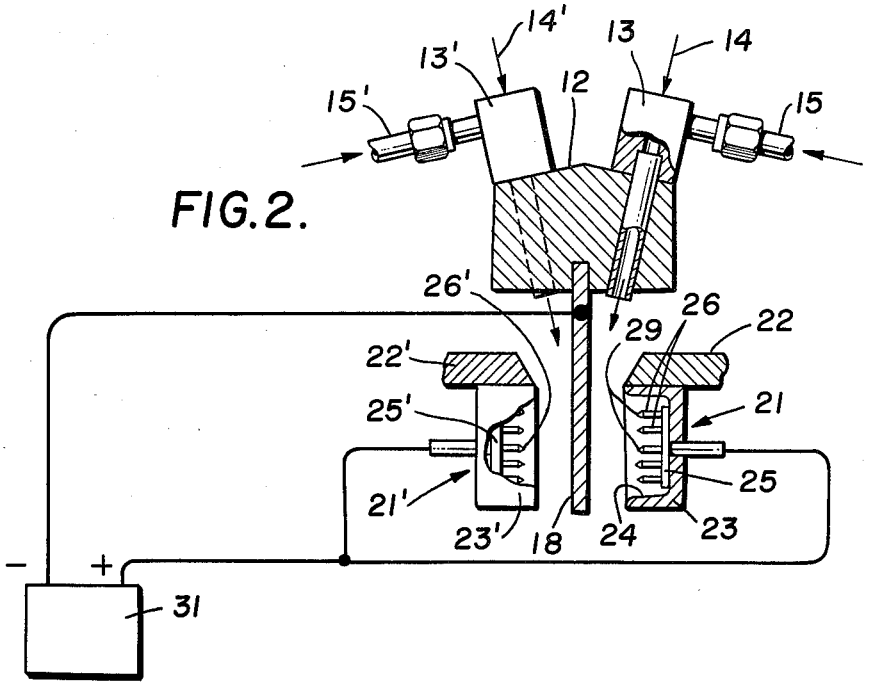
FIG. 2 is a front view of the apparatus of FIG. 1 showing the positioning of the attenuators and the electrodes which charge the filaments.

An elongated flat metal bar 18 secured between the end plates 11 and positioned between the outlet ends of the attenuators 13 and 13', as best shown in FIG. 2, serves as a target electrode for a corona charging system. The upper edge of the bar 18 is secured in a slot 19 in the member 12 to prevent lateral movement of the bar 18. The bar 18 is so positioned that the filament bundles exiting from the attenuators 13 and 13' impinge the opposite surfaces of the bar. The bar 18 is relatively thin, i.e., about 5 – 10 mm, to allow the filament bundles 14 and 14' to leave the charging zone in the form of fans which are sufficiently close together that filaments in the edges of each fan intermingle with filaments in the edges of adjacent fans to form a curtain below the target electrode and prior to contact with the collecting surface (not shown) on which the web is formed.

The intermingling of the edges of the fans prior to web formation results in a web which is characterized by the absence of clearly defined interfaces between groups of filaments in the web.

The charging electrodes 21 are each associated with and aligned with one of the attenuators or air nozzles 13, the attenuators 13 and the charging electrodes 21 being positioned on one side of the target electrode 18. The charging electrodes 21' are each positioned beneath and associated with one of the attenuators 13' and are positioned on the opposite side of the target electrode 18 from the charging electrodes 21.

The charging electrodes 21 are secured to a bar 22 extending between the end plates 11, while the charging electrodes 21' are secured to a bar 22' secured to and extending between the end plates 11. The end plates 11, the member 12 and the bars 22 and 22' make up a frame which supports the remainder of the apparatus.

Each of the charging electrodes 21 and 21' is made up of a block of insulating material 23 and 23', respectively, each having therein a recess 24 and 24'. In the recesses 24 and 24' are positioned conductive metal plates 25 and 25', respectively, having affixed thereto a plurality of corona discharge electrodes or pins 26 and 26'. The corona discharge pins 26 and 26' are provided with sharp tips 29 and 29' which serve to create corona discharge from these pins when the proper voltage is applied to the pins.

The corona discharge pins 26 are positioned in an array or row extending in a direction parallel to the path of the filament groups and are aligned with the filament groups in such a manner that each filament group passes several corona discharge electrodes in succession. In other words, each filament will pass through a plurality of electric fields created by the corona discharge pins 26.

If the electric field were measured at the target electrode along the path of the filaments the measuring instrument may not indicate separate electric fields, since the electric fields are not isolated from each other but are contiguous to and reinforce each other. However, it can be considered that the fields are separate or that there is a plurality of fields in the sense that the electric field at the target electrode emanates from a plurality of points or locations located along a line parallel to the filament path.

A DC voltage source 31 of high potential is connected to the charging electrodes 21 and 21' and the target electrode 18 in the manner shown in FIG. 2. The high intensity electric field created between the target electrode 18 and each of the pins 26 and the impingement on the target electrode causes each filament bundle to rapidly spread into a fan configuration as the filaments pass across the surface of the target electrode 18. The high intensity of the electric charge applied by the row of pins 26 insures excellent filament separation in each group of filaments.

The attenuators 13 and 13' and their associated charging electrodes 21 and 21', respectively, are positioned on opposite sides of the target electrode 18 in a staggered relationship as best shown in FIG. 1. This relationship allows a close spacing of the filament fans so that the filaments in edges of adjacent filament fans can intermingle below the target electrode 18 to provide a curtain of filaments going to the web formation zone.

The attenuators 13 and 13' are so positioned relative to the target electrode 18 that the filament bundles 14 and 14' impinge the target electrode at an angle of 0° to 60°, with the preferred angle being 0° to 20°, so that the filament direction of travel changes slightly. Impingement at this angle deflects the filaments laterally from their original path and initiates the spreading of the filament configuration from bundle to fan. The impingement area or region is that area in which the filament configuration begins to transform from bundle to fan.

The stream of air from the attenuator 13 flattens and flows across the target electrode 18 under high-velocity, low pressure conditions, carrying the filaments with it. The higher pressure surrounding air maintains the filaments in close proximity to the target electrode 18 without the use of any significant tension on the filaments. The absence of any significant tension on the filaments allows the filament bundle to spread as the filaments are being charged.

The fact that the filaments enter the charging field in bundle form rather than a wide ribbon permits high charging of all of the filaments in the group by the use of a single corona discharge pin rather than requiring an array of pins disposed across the path of the filaments, though several pins in a row along the filament path are preferred over a single pin. The fact that the filaments are allowed to separate as they are charged better exposes each filament to the charging field. In addition to better filament exposure, the fact that the filaments are separated allows a higher filament charge without the possibility of back corona from the charged filaments.

Figure 3:
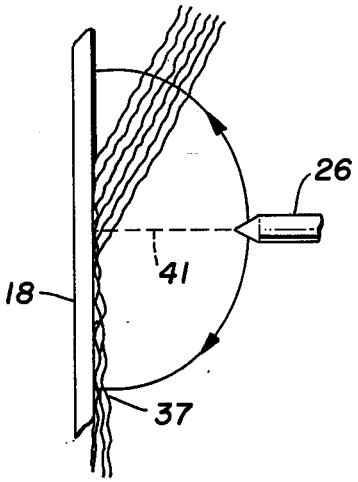
FIG. 3 is an enlarged side view showing in a schematic manner the positioning of the filament charging zone relative to the location at which the filaments spread from a bundle configuration to a fan configuration on the target electrode.
Figure 4:
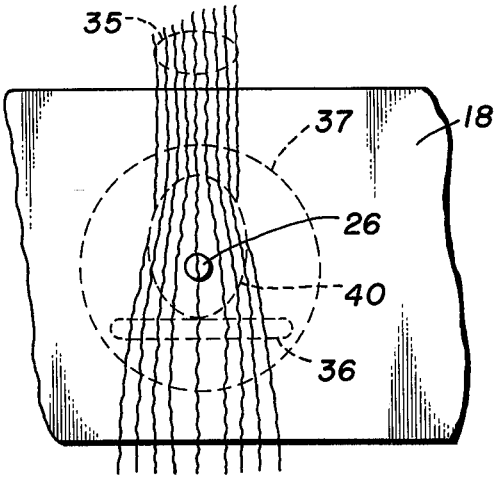
FIG. 4 is a front view showing in a schematic manner the positioning of the filament charging zone relative to the location at which the filaments spread from a bundle configuration to a fan configuration.

FIGS. 3 and 4 illustrate the transformation of the filament configuration from bundle to fan in the charging zone. The terms "filament configuration", "bundle", "fan" and "curtain" refer not to physical properties of the filament but to the configurations of the cross sectional areas occupied by the moving filaments at various points along the path of the filaments. The cross sectional area of the filament bundle, between the attenuator and the target electrode, is two dimensional. This area may be generally circular, as illustrated by dotted line 35 in FIG. 4, or it may be elliptical or even square or rectangular. The generally circular bundle configuration is preferred.

The dotted line 36 in FIG. 4 illustrates the fan configuration. The fan configuration has a cross sectional area, occupied by the filaments as they pass over the target electrode, which is more or less one dimensional in the sense that it is wider in one dimension and thinner in the other dimension than the bundle configuration.

The dotted line 37 in FIG. 4 schematically indicates the effective charging zone, this being the zone in which the filament configuration is transformed from bundle to fan. It should be understood however that no arbitrary zone can be delineated where it can be said that the filaments are charged inside the zone but not outside the zone, since the electric field does not abruptly stop at some point. The dotted line 37 in FIG. 4 is used merely to show the position of the charging zone relative to the location at which the filament configuration is transformed from bundle to fan.

The electric field is preferably positioned so that the axis of the electric field intersects the target electrode in the region of impingement of the filaments, the axis of the electric field being an imaginary line through the corona discharge pin 26 and normal to the target electrode.

Dotted line 40 in FIG. 4 closes the area within which the filaments impinge or first contact the target electrode. It will be noted that the axis of the pin 26, which in the embodiment shown is the axis of the electric field, intersects the area enclosed by line 40. In FIG. 3 the axis of the electric field is indicated by dotted line 41.

The transformation of the filament configuration from bundle to fan is begun by the spreading of the air stream on the target electrode. Total separation of the filaments is achieved by the charging of the filaments. The charging of the filaments not only promotes total separation of all of the filaments from each other but also prevents the rejoining of flaments below the target electrode, since the charged filaments repulse each other.

In FIGS. 3 and 4 only one corona discharge pin is shown, for the purpose of illustrating the invention. In the preferred embodiment, however, several pins are used, the pins being positioned in a row parallel to the direction of filament travel, as shown in FIGS. 1 and 2.

Figure 5:
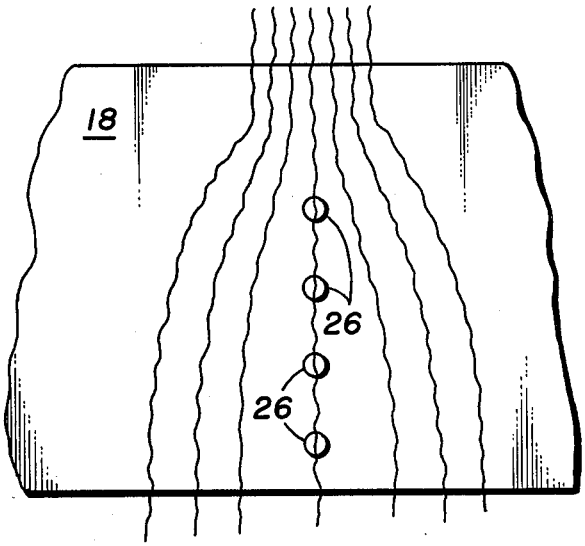
FIG. 5 is a front view showing the positioning of a plurality of corona discharge electrodes relative to a group of filaments being charged.

FIG. 5 illustrates the positioning of the row of corona discharge electrodes or pins of the preferred embodiment, with the uppermost pin being aligned with the filament impingement zone. The close spacing of the pins serves more or less to compress the individual electric fields to provide a very high intensity electric field through which the filaments pass.

What is claimed is:

1. An apparatus for forwarding and charging groups of filaments comprising a. an elongated frame, b. an elongated target bar supported by the frame, c. a plurality of spaced first gas driven nozzles mounted on the frame and positioned to forward first groups of filaments into impingement with one side of the target bar at spaced first locations thereon, d. a plurality of spaced first corona discharge electrodes mounted on the frame and positioned to apply electric fields to said first locations to charge said first groups of filaments, e. a plurality of spaced second gas driven nozzles mounted on the frame and positioned to forward second groups of filaments into impingement with the other side of the target bar at spaced second locations thereon, f. a plurality of spaced second corona discharge electrodes mounted on the frame and positioned to apply electric fields to said second locations to charge said second groups of filaments, g. said first nozzles and first electrodes being positioned in a staggered relationship relative to said second nozzles and second electrodes.

2. The apparatus of claim 1 wherein the electrodes each comprise a plurality of pins arranged in a row parallel to the direction of filament travel.

3. An apparatus for forwarding and charging groups of filaments, comprising:

a. a plurality of spaced fluid nozzles wherein each said nozzle is positioned for forwarding filaments in a bundle configuration along a predetermined path;

b. a target electrode positioned in said path in such a manner that said filament bundles forwarded by said nozzles impinge at spaced locations on said electrode at an angle of 0° to 60° and are spread by said electrode at a plurality of locations thereon;

c. a plurality of corona discharge electrodes positioned adjacent to said spaced locations, each of said discharge electrodes having a plurality of discharge pins positioned in a row extending in the direction of filament travel for applying electric fields to said locations to charge said filaments; and d. a voltage supply connected to said corona discharge electrodes for creating said electric fields.

* * * * *